US005425540A

United States Patent [19]

Senel

[11] Patent Number: 5,425,540

[45] Date of Patent: Jun. 20, 1995

[54] SELECTIVELY MAGNETICALLY ATTRACTIVE GAME BOARD ASSEMBLY

[76] Inventor: Cecile Senel, 15 Front St., Chatham, N.J. 07928

[21] Appl. No.: 308,298

[22] Filed: Sep. 19, 1994

[51] Int. Cl.[6] ..... A63F 3/00

[52] U.S. Cl. ..... 273/239; 273/287

[58] Field of Search ..... 273/236, 239, 242, 243, 273/287

[56] References Cited

U.S. PATENT DOCUMENTS

| | | | |
|---|---|---|---|
| 3,658,336 | 4/1972 | Knapp | 273/239 |
| 3,871,657 | 3/1975 | Lorenz et al. | 273/239 |
| 4,101,131 | 7/1978 | Barnby | 273/239 |
| 4,398,893 | 8/1983 | Johns | 273/239 X |
| 4,875,688 | 10/1989 | Whaley | 273/287 |
| 5,342,057 | 8/1994 | Sorkoram | 273/239 |

FOREIGN PATENT DOCUMENTS

| | | | |
|---|---|---|---|
| 1433603 | 2/1966 | France | 273/239 |
| 2254010 | 9/1992 | United Kingdom | 273/239 |

*Primary Examiner*—William E. Stoll

*Attorney, Agent, or Firm*—Bernard J. Murphy

[57] ABSTRACT

A transparent game platform has a panel of ferrous metal slidably underlying for causing game pieces, with magnetic elements therein, to adhere to the platform where and when emplaced thereon. However, the panel is extractable from under the platform, to render the latter magnetically passive, so that game pieces can be displaced about the platform with slidable ease. Consequently, the game platform can be made non-magnetic to accommodate a free, slidable movement of game pieces thereon, as appropriate for whatever shall be the game, or can be made magnetic (a) to hold the game pieces in place, and (b) to accommodate storage of the platform and game pieces in an at-halt disposition thereof, respectively.

12 Claims, 1 Drawing Sheet

SELECTIVELY MAGNETICALLY ATTRACTIVE GAME BOARD ASSEMBLY

This invention pertains to game bard assemblies, and in particular to game board assemblies which are magnetically attractive. Such are well known in the prior art, typical thereof being the magnetic chess bard which has achieved popularity for use during auto travel, and the like.

The magnetically attractive game bard assembly, for chess, or jigsaw puzzles, and the like, has been popular for the obvious reason that it enables one to move game pieces thereupon with a assurance that the pieces will remain where emplaced, even if the game bard is tilted, stood vertically disposed, or even inverted. Too, if the game board is for a jigsaw puzzle, one can leave the puzzle incomplete, and place the game board on end, in a closet, or cabinet, for temporary storage, until it is desired to return to a completion of the puzzle.

The magnetically attractive game bard assembly, then, has the self-evident benefit of holding magnetic game pieces, chess pieces, jigsaw pieces, and such, on the board where emplaced. However, with the benefit there is a concomitant disadvantage. Game pieces, magnetically held to a game board are difficult to extract for movement clearly, they have to be picked off the bard, with some effort, and then placed thereon again. Over time, this becomes a burden, and tiresome.

What has been needed is a game board assembly which is selectively magnetically attractive, so that one can elect to have it magnetically attractive or magnetically passive, when and as it is deemed fit. Accordingly, then, the game board will permit game pieces to be moved without effort, when the board is magnetically passive, and will hold the pieces securely in place when the board is magnetically attractive.

It is an object of this invention to set forth just such a long sought game board assembly, i.e., one which is selectively magnetically attractive.

Particularly, it is an object of this invention to disclose a selectively magnetically attractive game board assembly, comprising a game platform; a panel (a) underlying and engaging said platform, and (b) movable relative to said platform; and means engaged with at least said platform for guiding said panel in movement thereof relative to said platform; wherein said panel comprises means for attracting magnetic elements.

Further objects of this invention, as well as the novel features thereof, will become apparent by reference to the following description, taken in conjunction with the accompanying figures, in which.

Figure 1:
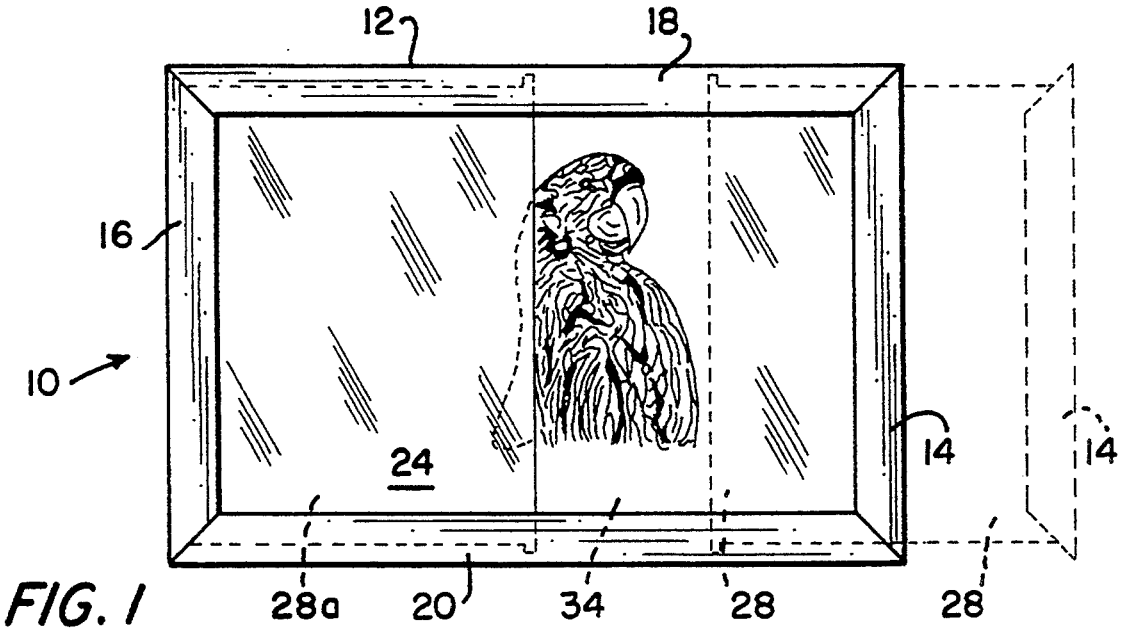
FIG. 1 is a plan view of the novel, selectively magnetically attractive game board assembly, according to an embodiment thereof.
Figure 2:
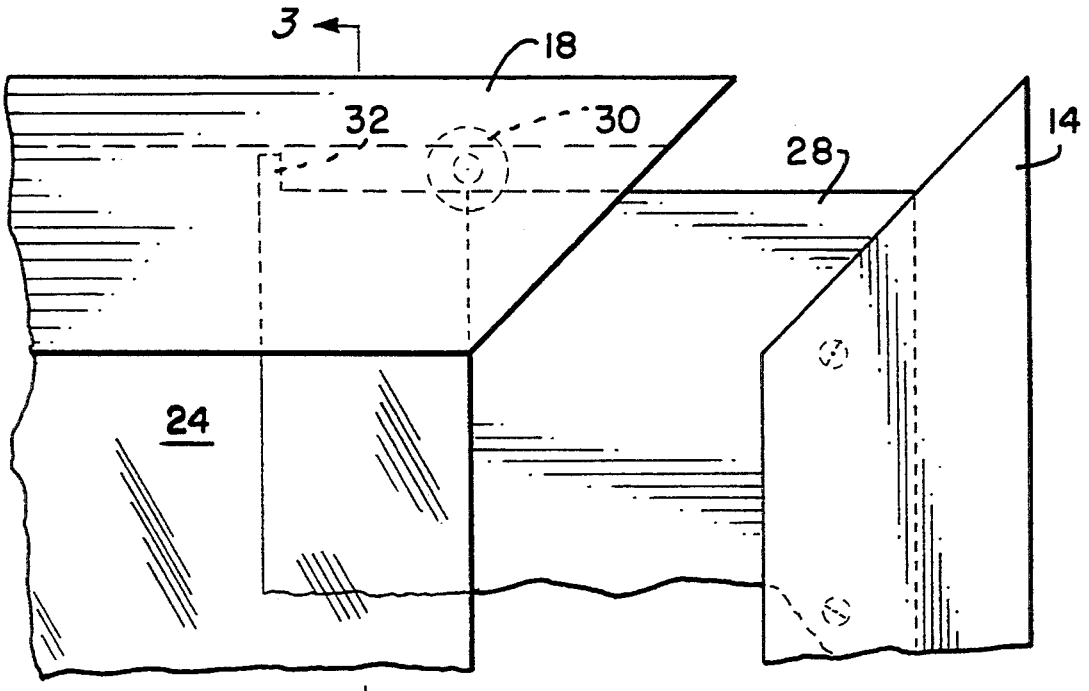
FIG. 2 is a greatly enlarged, fragmentary illustration of a corner of the game board assembly of FIG. 1, the same showing the movable panel partly withdrawn from the game platform.
Figure 3:
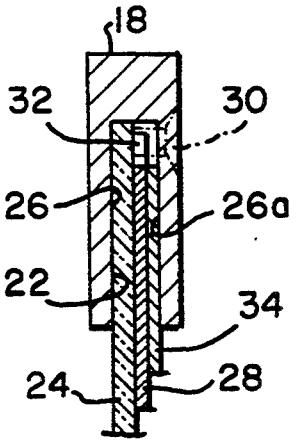
FIG. 3 is a cross-sectional view taken along section 3—3 of FIG. 2.

As shown in the figures, the novel game board assembly 10 comprises a frame 12, the latter comprising end frame members 14 and 16, and side frame members 18 and 20. The side frame members 18 and 20 have channels 22 (only one of which is shown) formed therein. A game platform 24, here shown to be of glass, is cemented to an upper surface 26 of the members 18 and 20, within the channels 22. A panel 28, formed of ferrous metal , i.e., stainless steel in this embodiment, is slidably engaged with the channels 22, and fastened, at an outermost end thereof, to end frame member 14. Too, an identical panel **28*a*, also of stainless steel, is engaged with channels 22, slidably, and is fastened to end frame member 16**.

Panels 28 and **28*a* extend half-way across the board assembly, and meet in the middle thereof to present, beneath platform 24, a full sheet of magnetically attractive steel. Consequently, with game pieces having magnetic elements fixed therein set upon the platform 24, they will be magnetically held, where emplaced, due to the magnetic attraction of the panels 28 and 28*a***. Self-evidently, the game pieces with the magnetic elements therein (not shown) can be chess pieces, or jigsaw pieces, or the like.

While the game platform 24 is being used by someone, it is only necessary to slidably extract the panels 28 and **28*a* to prevent the game pieces from adhering to the platform 24 when they are positioned. Simply, the game pieces will be freely slidable upon the platform, and the magnetic attraction of the panels 28 and 28*a* is held away so as to simplify the pursuit of the game, with the freely slidable pieces. Frame members 14 and 16 are pulled away from the assembly 10, and they slide the panels 28 and 28*a* therewith out of the channels 22**.

If the panels 28 and **28*a* were to be fully removed from the board assembly 10, there is the risk that one or the other thereof would become misplaced. Consequently, the invention comprehends means for capturing the panels 28 and 28*a* in the assembly 10. At opposite ends of the channels 22, obstructing screws 30 are in penetrating traverse of the channels 22, and innermost ends of the panels 28 and 28*a* have laterally-extending tabs 32. When the panels 28 and 28*a* are extracted along the channels 22, the tabs 32 engage the obstructing screws 30 and can travel no further. They remain, then, withdrawn and at rest to opposite ends of the board assembly 10 while the game platform is being used. When game play is suspended, the panels 28 and 28*a* are simply slid back into the channels 22** to hold the magnetic game pieces where they have been placed.

Set within the channels 22 and cemented therein the same as the glass platform 24 is a sheet 34 of non-ferrous material, the same being fiberboard in this embodiment. Sheet 34 is cemented to the lower surface 26a of the members 18 and 20 in channels 22. The sheet 34 and the platform 24 cooperatively form a trackway therebetween through which the panels 28 and **28*a* slide in and out. Too, the sheet 34 provides a display surface which, in an embodiment of the invention, bares an illustration. Where the game board assembly 10 comprises a jigsaw puzzle, the illustration is of the to-be-completed puzzle. Therefore, when the panels 28 and 28*a* are outwardly withdrawn, the sheet 34 discloses to the player what the end object of the puzzle is when completed. FIG. 1 shows an illustration partly exposed on the sheet 34**.

In an alternative embodiment of the invention, the sheet 34 is not cemented to surface **26*a*. Rather, it is of two halves, and each half is cemented to one of the panels 28 and 28*a*. Now, when the panels 28 and 28*a* are withdrawn from the assembly 10, the non-ferrous, fiberboard material halves slide outwardly therewith. The obstructing screws 30 are threadedly withdrawn from the channels 22, so that the panels 28 and 28*a* and the halves of sheet 34 can fully exit the assembly 10. Then, the composite panels 28 and 28*a* and fiberboard halves can be inverted and slid back into the channels. In this disposition, the fiberboard material insulates the game pieces from the metallic attraction of the panels 28 and 28***a*, and the game pieces can be moved across the platform without significant effort. Again, when game play is halted, and one wishes to preserve the positioning of the magnetic game pieces, the composite panels 28 and 28*a*, with the fiberboard halves cemented thereto, are slid out of the channels 22, inverted again, and returned into the channels 22.

While I have described my invention in connection with specific embodiments thereof, it is to be clearly understood that this is done only by way of example, and not as a limitation to the scope of the invention, as set forth in the objects thereof and in the appended claims. For instance, the game platform 24 is disclosed as of glass construction. It need not be. It could just as well be some sort of firm plastic; simply, it is desirable that the platform 24 be reasonably firm, and transparent. Too, the sheet 34 is defined as of fiberboard material. It simply has only to be non-ferrous; therefore, it could be plastic, or aluminum, or such. Panels 28 and 28*a* are shown slidably engaged with the game platform 24, via side frame members 18 and 20. In an alternative practice of my invention, the panels—or one panel such as panel 28 or 28*a*—could be hingedly joined to the platform 24, and pivoted away from the platform 24, to render the latter magnetically passive for game play, and pivoted toward the platform, into parallelism therewith, to render the platform magnetically active for the game pieces. All such alternative embodiments and variations of the invention are deemed to proceed from my disclosure herein, and are held to be within the ambit of the disclosure and embraced by the appended claims.

I claim:

1. A selectively magnetically attractive game board assembly, comprising:

a game platform;

a panel (a) underlying and engaging said platform, and (b) movable relative to said platform; and means engaged with at least said platform for guiding said panel in movement thereof relative to said platform; wherein said panel comprises means for attracting magnetic elements.

2. A selectively magnetically attractive game board assembly, according to claim 1, wherein:

said guiding means comprises frame members; and said frame members have channels formed therein.

3. A selectively magnetically attractive game board assembly, according to claim 2, wherein:

said panel is slidably engaged with said channels.

4. A selectively magnetically attractive game board assembly, according to claim 3, wherein:

said channels have obstructions disposed therein; and said panel has abutments means formed thereon for abuttingly engaging said obstructions.

5. A selectively magnetically attractive game board assembly, according to claim 4, wherein:

said obstructions are selectively removable from said channels.

6. A selectively magnetically attractive game board assembly, according to claim 4, wherein:

said obstructions comprises screws threadedly engaged with said frame members and in traverse of said channels.

7. A selectively magnetically attractive game board assembly, according to claim 1, wherein:

said panel comprises a sheet of ferrous metal.

8. A selectively magnetically attractive game board assembly, according to claim 1, wherein:

said panel comprises a sheet of non-ferrous material.

9. A selectively magnetically attractive game board assembly, according to claim 1, further including:

a sheet of non-ferrous material; and wherein said panel is interposed between said platform and said sheet.

10. A selectively magnetically attractive game board assembly, according to claim 9, wherein:

said platform and said sheet are fastened to said guiding means; and said platform and said sheet cooperatively form trackways therebetween.

11. A selectively magnetically attractive game board assembly, according to claim 10, wherein:

said panel is slidably engaged with said trackways.

12. A selectively magnetically attractive game board assembly, according to claim 9, wherein:

said sheet has an illustration thereon.

* * * * *